United States Patent [19]

Kribs et al.

[11] 4,400,763

[45] Aug. 23, 1983

[54] PORTABLE LIGHT

[75] Inventors: David E. Kribs, P.O. Box 67, Haines City, Fla. 33844; Robert Burton, Park Ridge, N.J.

[73] Assignee: David E. Kribs, Haines City, Fla.

[21] Appl. No.: 319,118

[22] Filed: Nov. 9, 1981

[51] Int. Cl.[3] ..... F21L 15/08

[52] U.S. Cl. ..... 362/103; 362/105; 362/190; 362/191; 362/199; 362/200

[58] Field of Search ..... 362/190, 191, 199, 200, 362/103, 105

[56] References Cited

U.S. PATENT DOCUMENTS 2,947,851 8/1960 Lozeau ..... 362/187

4,319,309 3/1982 Benoit ..... 362/200

*Primary Examiner*—Stephen J. Lechert, Jr.

*Attorney, Agent, or Firm*—Duckworth, Allen, Dyer & Pettis

[57] ABSTRACT

A portable light is disclosed having a box-shaped housing with a rectangular front opening adapted to secure pivotally a front plate to which a conical reflector and incandescent light are attached. The housing supports an interior battery and is provided with a plurality of exterior L-shaped members on each of its exterior sides. A corresponding substantially oval-shaped clasp is provided at each end of a belt which is threaded through slots in a flexible oblong member for attachment to the housing. Alternatively, the portable light can be mounted on a bracket mount secured on a wall surface or clipped onto the user's clothing.

7 Claims, 8 Drawing Figures

FIG. 1
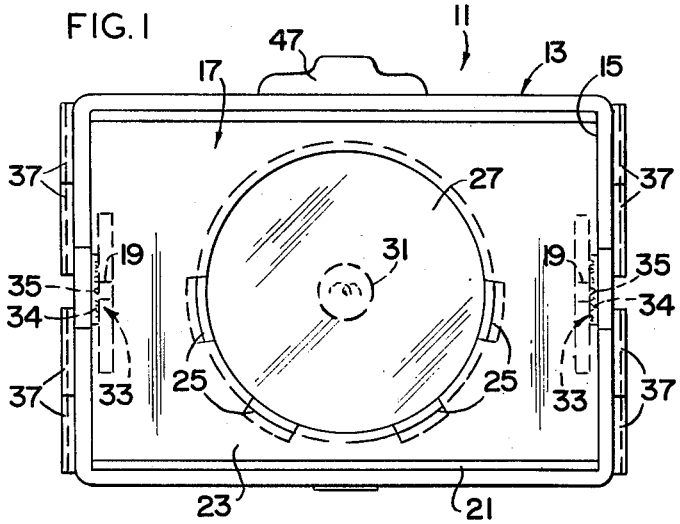
FIG. 2
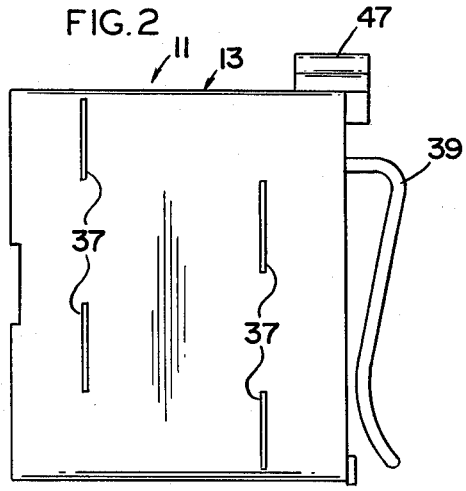
FIG. 3
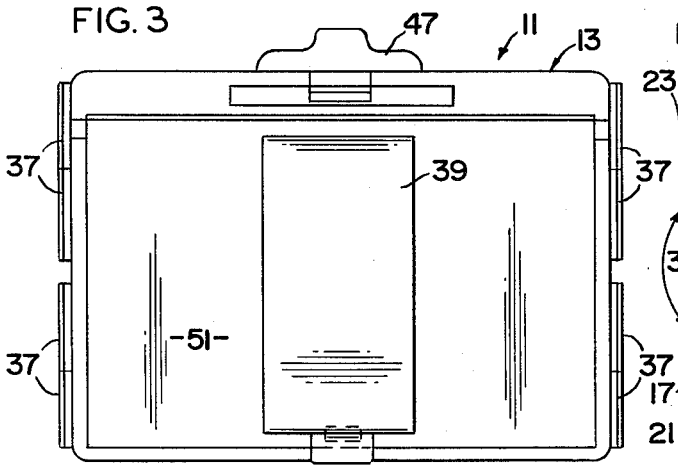
FIG. 4
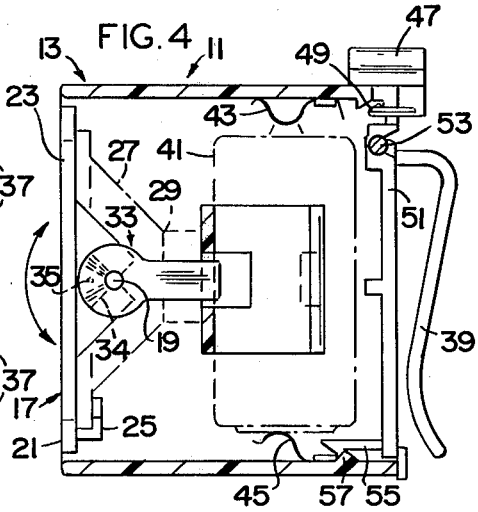
FIG. 6
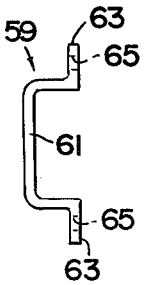
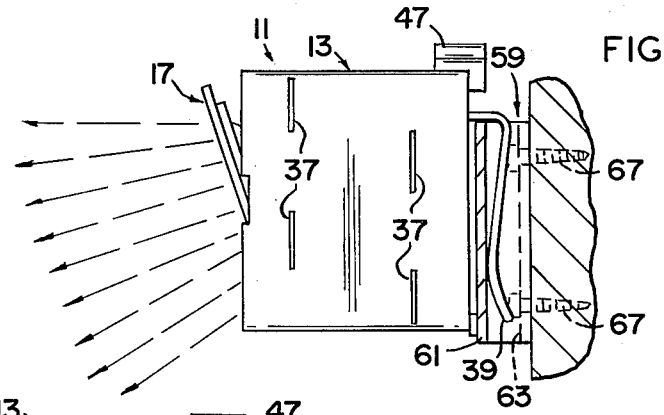
FIG. 5
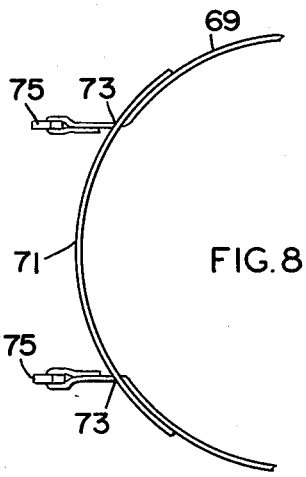
FIG. 8
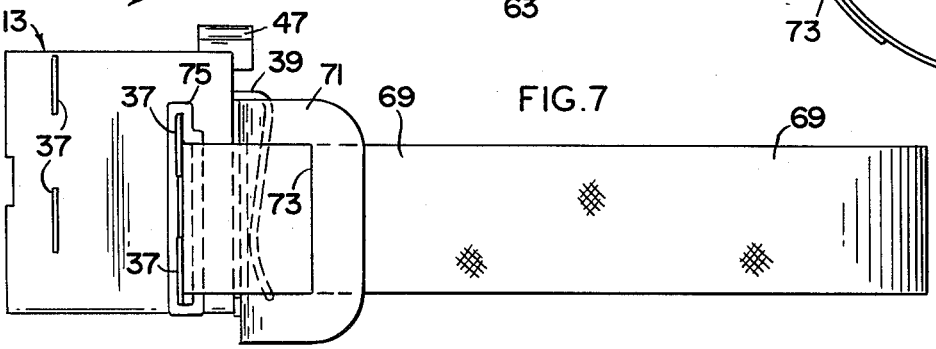
FIG. 7

PORTABLE LIGHT

BACKGROUND OF THE INVENTION

1. Field of the Invention

This invention relates generally to portable utility lights that can be used with hats or caps worn by workers in various occupations. More particularly, it relates to a light with a moveable front plate-reflector combination and having an adjustable headband size, as well as alternative mounting means.

2. Background of the Invention

Numerous lights have been disclosed in the prior art, including for example U.S. Pat. No. 1,217,666 (Thulin, 1917); U.S. Pat. No. 2,164,898 (Brown, 1939); U.S. Pat. No. 2,234,995 (Waechter, 1939); U.S. Pat. No. 3,250,909 (Oldenburger, 1966); U.S. Pat. No. 3,912,919 (Eriksson, 1975); and U.S. Pat. No. 4,002,895 (Ketler, 1977). The disadvantages of the prior art devices is that generally they are bulkier, not as adjustable, and are not provided with the adjustable feature of the L-shaped member disposed on the housing and oval-shaped clasps disposed at the ends of the flexible band.

SUMMARY OF THE INVENTION

The present invention provides a portable lamp having a box-shaped housing with a rectangular front opening, and at least one battery disposed in and supported by said housing. A rectangular front plate member is pivotally attached to the housing and provided with a conical reflector including an opening for an incandescent lamp. The housing is provided with a plurality of L-shaped members disposed on the exterior sides of the housing. The rear of the housing is provided with a clip connector for attachment to a headband, to a bracket mount, or to an article of the user's clothing. A switch is disposed at the top of the housing to provide an on/-off capability.

Because of the geometric construction of the lamp, the versatility and the adjustability both in the angle of the illumination which may be obtained and in the means about which and to which the lamp may be connected, the lamp of the present invention provides excellent versatility.

BRIEF DESCRIPTION OF THE DRAWINGS

Further details are explained below with the help of the examples illustrated in the attached drawings in which:

FIG. 1 is a front elevation view of the light of the present invention;

FIG. 2 is a side elevation view of the light of the present invention;

FIG. 3 is a rear elevation view of the light of the present invention;

FIG. 4 is a sectional view of the light of the present invention;

FIG. 5 is a side view of the light of the present invention when engaged to a bracket mount attached to a wall surface;

FIG. 6 is a top plan view of the bracket mount;

FIG. 7 is a side view of the light of the present invention with an associated headband; and FIG. 8 is a top view of the headband construction of the present invention.

Similar reference characters refer to similar parts throughout the several views of the drawings.

DETAILED DESCRIPTION

Illustrated in FIG. 1 is the portable light 11 of the present invention. The light 11 includes a box-shaped housing generally indicated at 13 preferably molded in plastic having a rectangular opening 15 at the front end thereof. A rectangular front plate member 17 is movably disposed within the rectangular opening 15 and is attached to the interior portion of the housing 13 at pivot points 19. As better illustrated in FIG. 4, the front plate member 17 includes a rectangular plastic rim section 21 which holds a substantially transparent plate 23. The front plate member 17 also includes a plurality of flanges 25 which are used to receive and hold a truncated conical reflector 27. The truncated conical reflector 27 is provided with a circular opening 29 which supports an incandescent lightbulb 31. It can be seen from the geometry described that the front plate member 17 can be pivoted about pivot points 19 thereby directing the beam of light from bulb 31 to a desired spot. A pivot clutch 33 comprising a circular plastic portion with a plurality of grooves 34 radially disposed thereon is secured to the housing 13 and adapted to be engaged by a protrusion 33 formed in the front plate member 17 at pivot points 19. The protrusion 35 engages the grooves 34 in the pivot clutch 33 thereby temporarily securing the front plate member 17 at a desired position. When the position of the front plate member 17 is to be changed, pressure is exerted on the front plate member 17 which causes protrusion 35 to be displaced across the grooves 34 of the pivot clutch 33 to a new desired position.

To facilitate versatility in mounting, the housing 13 is provided with a plurality of members 37 having an L-shaped cross section (L-shaped members). These L-shaped members 37 may be integrally molded of the same plastic as the housing 13. Attached to the rear portion of the housing 13 is a clip 39 which is used for securing the light 11 to different surfaces.

The housing 13 is adapted to support at least one battery 41 to provide the necessary electrical energy to the incandescent lightbulb 31. The battery 41 is disposed so as to contact upper batter contact 43 and lower batter contact 45. A switch button 47 is connected to a lever 49 and is used alternatively to open and close the electrical circuit between the battery and the incandescent lightbulb 31 (wires are not shown).

Access to the interior portion of the housing 13 is provided by a rear plate 51 which is pivotally mounted on the housing at rear plate pivot points 53. The clip 39 is attached to the rear plate 51. The rear plate 51 is locked in place by means of a locking member 55 which extends into the interior of the housing 13 and engages a protrusion 57 built into the interior of the housing.

The light 11 thus described can be mounted on a wall surface by means of a bracket mount generally indicated by 59 and best seen in the views of FIGS. 5 and 6. The bracket mount 59 is illustrated in sectional FIG. 5, and includes a C-shaped portion 61 and two planar protrusions 63, each including a pair of openings 65 adapted to receive screws 67 therethrough. The bracket mount 59 can be secured to a wall surface by the screws 67 and the light 11 is then attached to the bracket mount 59 by forcing the clip 39 through the C-shaped portion 61 of the bracket mount 59.

As illustrated in FIGS. 7 and 9 the light 11 can be mounted on a belt 69 for use as a headband or a waistband. The belt embodiment of FIG. 7 includes a flexible oblong member 71 having a pair of slots 73. A flexible belt 69 is threaded through the slots 73 and is provided at each end with a clasp member 75 having a substantially oval shape. The clasp members 75 are used to engage the L-shaped member 37 formed on the housing 13 of the light 11. The diameter of the belt 69 can be adjusted by engaging the clasp members 75 to different L-shaped members 37 which are formed at the side of the housing 13 to vary the effective length of belt 69 to these different dimensions. Thus, the light 11 can be used with a stationary mount on a wall surface, or in conjunction with a belt either as a headband or as a waist belt, or light 11 may be clipped onto an article of the user's clothing. Obviously, belt 69 would be longer if used as a waist belt than as a headband.

It will thus be seen that the objects set forth above, among those made apparent from the preceding description are efficiently attained, and since certain changes may be made in the above article without departing from the scope of the invention, it is intended that all matter contained in the above description, or shown in the accompanying drawings shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

Now that the invention has been described,

What is claimed is:

1. A portable light comprising:

a box-shaped housing having a rectangular front opening;

a battery disposed in said housing;

means disposed on said housing for supporting said battery;

a rectangular front plate member disposed within said rectangular front opening and pivotally connected to said housing;

a truncated conical reflector including a circlar opening therein, said conical reflector being attached to said rectangular front plate member;

an incandescent lamp disposed in said circular opening and in fixed relation to said reflector;

a switch movably disposed at the top of said housing, said switch being operatively connected to said battery and said incandescent lamp to regulate the flow of electricity thereto;

a plurality of L-shaped members formed on the sides of said housing; and a clip connector attached to the rear of said housing.

2. The light of claim 1 wherein said rectangular front plate member comprises:

a rim section pivotally connected to said housing; and a rectangular transparent plate secured by said rim portion.

3. The light of claim 1 further comprising:

a bracket mount adapted to receive said clip; and means for securing said bracket mount to a support surface.

4. The light of claim 1 further comprising:

a flexible oblong member including a pair of slots at either end thereof;

a flexible belt having two free ends adapted to be threaded through said slots; and a clasp member secured to each of said free ends of said flexible belt; each of said clasp members being configured to removably engage at least a corresponding one of said plurality of L-shaped members.

5. The light of claim 4 wherein said flexible member is coupled to said clip connector.

6. The light of claim 1 further comprising a rear plate pivotally mounted on said housing and wherein said clip connector is attached to said rear plate.

7. The light of claim 1 further comprising:

a pivot clutch formed on the interior of each side of said housing; and a protrusion formed on said front plate member in engaging relation to said pivot clutch, whereby said pivotal connection between said housing and said front plate member may be positively adjusted.

* * * * *

UNITED STATES PATENT AND TRADEMARK OFFICE

CERTIFICATE OF CORRECTION

PATENT NO. : 4,400,763

DATED : August 23, 1983

INVENTOR(S) : David E. Kribs and Robert Burton

It is certified that error appears in the above-identified patent and that said Letters Patent are hereby corrected as shown below:

Column 4, line 1, delete "circlar" and insert --circular--.

Signed and Sealed this

*Eighteenth* Day of *October 1983*

[SEAL]

*Attest:*

GERALD J. MOSSINGHOFF

*Attesting Officer*

*Commissioner of Patents and Trademarks*